US005847301A

United States Patent [19]

Steinbuhler

[11] Patent Number: 5,847,301

[45] Date of Patent: Dec. 8, 1998

[54] STIFFENED KEY

[76] Inventor: David Steinbuhler, 901 North St., Titusville, Pa. 16354

[21] Appl. No.: 777,152

[22] Filed: Dec. 26, 1996

[51] Int. Cl.[6] ..... G10C 3/12

[52] U.S. Cl. ..... 84/433

[58] Field of Search ..... 84/433

[56] References Cited

U.S. PATENT DOCUMENTS

| | | | |
|---|---|---|---|
| 2,530,712 | 11/1950 | Martin | 84/433 |
| 2,584,319 | 2/1952 | Appel | 84/433 |
| 3,120,146 | 2/1964 | Stiles | 84/433 |

*Primary Examiner*—William M. Shoop, Jr.
*Assistant Examiner*—Kim Lockett
*Attorney, Agent, or Firm*—Reed Smith Shaw & McClay LLP

[57] ABSTRACT

An improved key for keyboard musical instruments, being particularly suited for reduced width keys, provides for greater structural stiffness and torsional rigidity to improve the feel and response of the key. The key comprises a playing end member mounted on top of one end of a bracing member and a key shank mounted on top of the second end of the bracing member, with the free end of the key shank able to engage a capstan mechanism.

17 Claims, 6 Drawing Sheets

STIFFENED KEY

BACKGROUND OF THE INVENTION

The present invention relates generally to the field of keyboards for pianofortes and, more particularly, to an improved piano key for use in pianos with reduced width keys having increased stiffness and torsional rigidity. Torsional rigidity is defined to be the ability to resist twisting movements about the longitudinal axis of the key.

Although pianos have been know for centuries, it is only recently that substantial efforts have been made to produce pianos with keyboards that have a total width smaller than the width of conventional keyboards. Such reduced-width keyboards are extremely helpful to piano players with small hands, such as women and children, who otherwise experience great difficulty in reaching the keys necessary to play the chords of some of the famous works of music that traditionally were written by male composers with larger hands.

To produce reduced-width keyboards it is necessary to have keys with smaller widths than conventional piano keys. Quite often such reduced width keys also have reduced cross sectional areas along the length of the key. This reduced cross sectional area results in keys with a lower ability to resist torsional forces and bending moments that are encountered during playing. Additionally, to adapt an existing conventional piano keyboard to a reduced-width piano keyboard it is necessary that many of the keys have the playing end portion of the key offset from the key's pivot point. Typically, the magnitude of the offset increases for the piano keys at the upper and lower ends of the keyboard corresponding to the ends of the spectrum of musical notes produce by the piano.

It has been discovered that in reducing the width of the piano keys to produce a reduced width keyboard, the resulting keys possess a lower structural stiffness; attributed to the reduction in the cross sectional area of the key shank and playing end portion. Unfortunately, the reduced stiffness permits the key to flex more during playing than the flexing normally experienced with conventional keys. Additionally, the reduced width keys also have a tendency to torsionally flex about the key's longitudinal axis. Ultimately, these adverse consequences result in piano keys that have a "spongy" feel to them when played and an overall degradation in the responsiveness of the keys. Consequently, an improved piano key that can be built in a smaller width than conventional keyboards while maintaining or increasing the stiffness and torsional rigidity of the key, and thereby, improve the overall feel and response of the key, has been desired.

SUMMARY OF THE INVENTION

The present invention provides an improved key for use in upright and concert pianos. The improved key design is equally applicable to both whole-note and half-note keys. Furthermore, the improved key is especially suitable for offset keys, piano keys in which the playing end portion of the piano key is offset from the key's pivot point. While the present invention is particularly applicable to reduced-width keyboards, it may also be practiced on or applied to standard keyboards, such as those in existing pianos and organs.

According to a first aspect of the present invention the improved key includes a playing end member mounted on top of one end of a bracing member. A key shank, which includes the key's pivot mechanism and connects to elements that engage the piano's capstan mechanism, is mounted on top of the other end of the bracing member. Unlike prior art keys, the playing end member of the key is physically separate and discontinuous from the key shank.

According to a second aspect of the present invention the improved key includes a playing end member mounted on top of one end of a bracing member. A key shank is continuous with the playing end member. The second end of the bracing member is mounted to a portion of the bottom surface of the key shank.

According to a third aspect of the present invention an improved key unit includes a first key and a second key. The first key includes a playing end member mounted on top of one end of a bracing member. A key shank that is discontinuous from the playing end member is mounted on top of the other end of the bracing member. The bracing member has a center portion with a width greater than the width of the key shank. The second key includes a playing end member continuous with a center portion which is continuous with a second key shank. The center portion of the second key is disposed above center portion of the first key and has a width greater than the width of the second key shank and substantially the same as the width of the center portion of the bracing member of the first key.

The present invention, together with other aspects and attendant advantages, will best be understood upon consideration of the following detailed description taken in conjunction with the accompanying drawings.

DETAILED DESCRIPTION OF THE PRESENTLY PREFERRED EMBODIMENTS

Typically, every keyboard or similar device includes a multitude of keys. However, for ease of explanation, the present invention is described below at times in terms of a single key.

Figure 1:
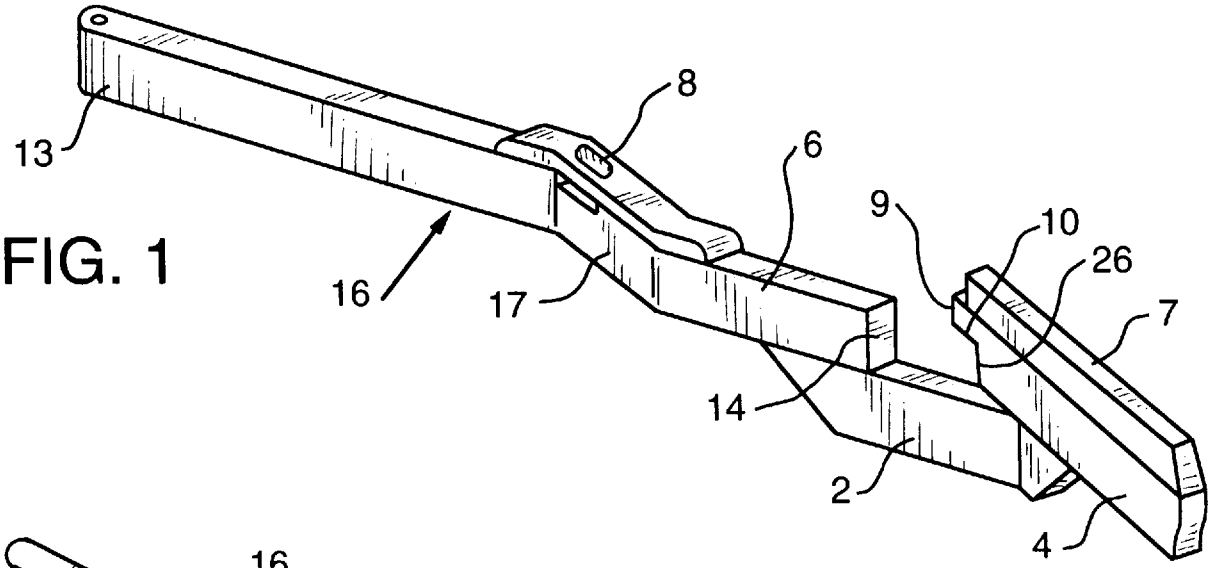
FIG. 1 is a top perspective view of a first preferred embodiment of the present invention.

Turning now to the drawings, as depicted in FIG. 1, the improved key generally comprises a playing end member 4, a key shank 16 and a bracing member 2. The playing end member 4 is the portion of the key touched by the player during the playing of the keyboard. The key shank 16 encompasses the rear of the key and includes a key shank front portion 6; a middle portion 17; which contains a pivot opening 8; and a tail portion 13 that connects to elements that engage the piano's capstan mechanism.

Figure 1A:
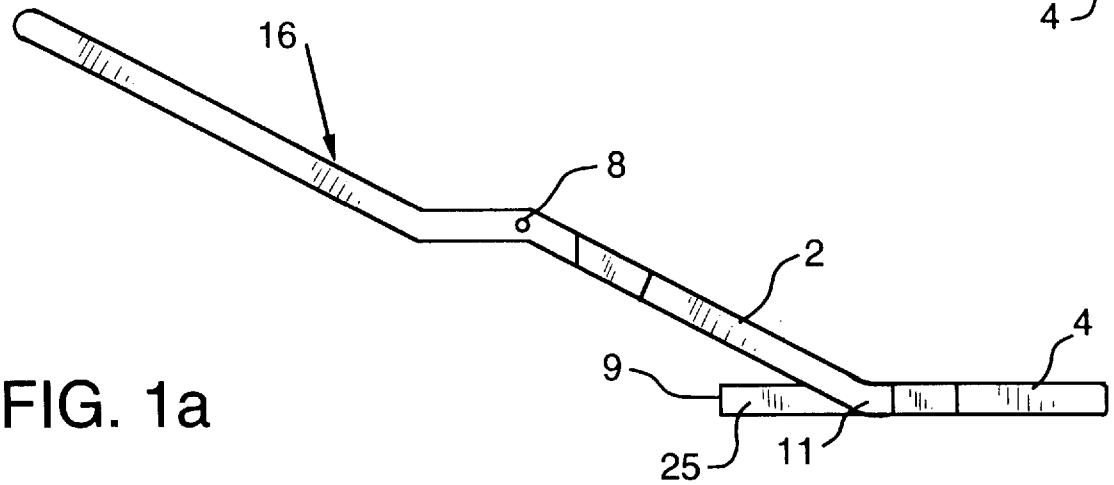
FIG. 1*a* is a bottom view of a first preferred embodiment of the present invention.
Figure 3:
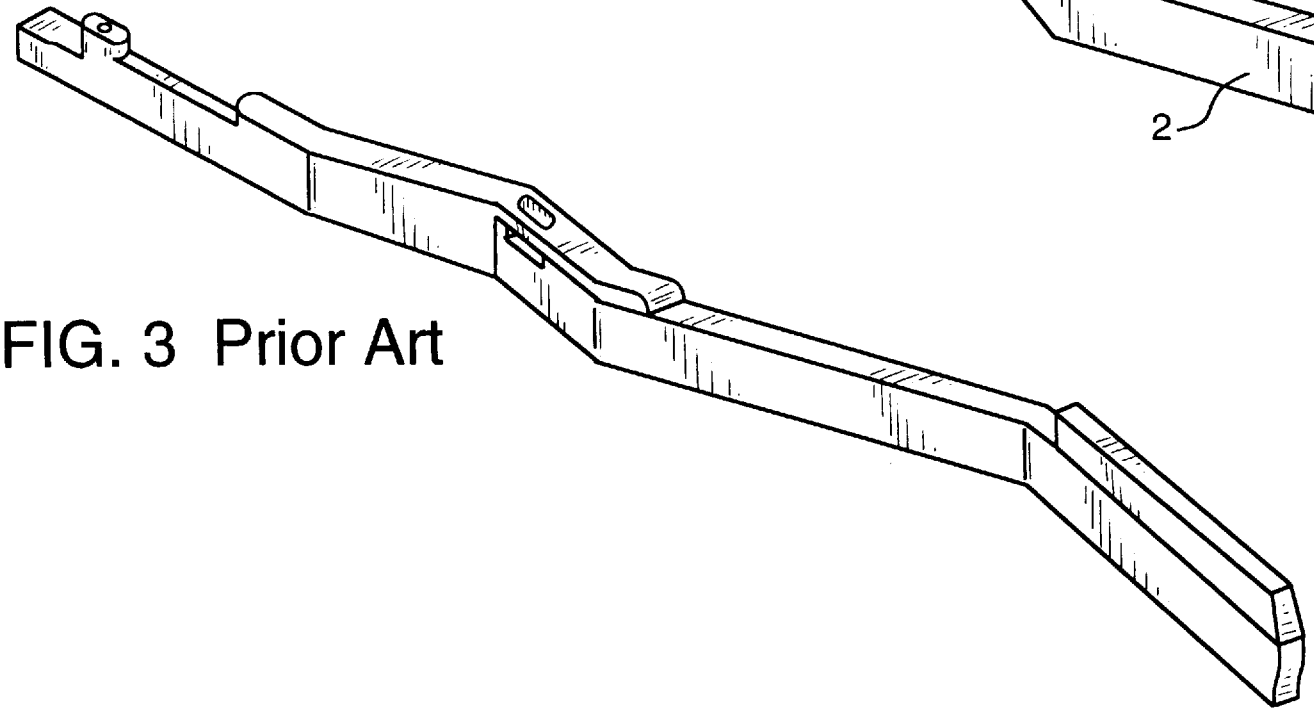
FIG. 3 Prior Art
FIG. 3 is a perspective view of a prior art key.

In contradistinction to the prior art keys, as depicted in FIG. 3, the present invention has a bracing member 2 disposed below the playing end member 4 and key shank 16. As installed in a piano keyboard, the bracing member 2 sits in a space above the keyboard bed and between the rails (not shown) underlying the playing end of the keys and the pivot opening of the keys. One end of the bracing member 2 is connected along the bottom surface of the key shank's front portion 6. The other end of the bracing member is connected to the playing end member 4 along the bottom surface of the playing end member and inwards from the rear end 9 of the playing end member. Preferably the bracing member should be mounted from the rear end 9 of the playing end member approximately one fourth to one half of the length of the playing end member. By mounting the bracing member 2 inwards from the end of the playing end member the moment arm between the centerline of the playing end member and the pivot opening 8 is reduced, thereby improving the torsional rigidity of the key. To increase the mounting contact area, and thereby increase the stiffness of the key, the bracing member can have a curved end 11 connected to and extending along the bottom surface of the playing end member, as shown in FIG. 1*a*. Curving the end of the bracing member also permits the playing end member to be mounted on the bracing member at an angle relative to the front portion of the key shank.

Figure 1B:
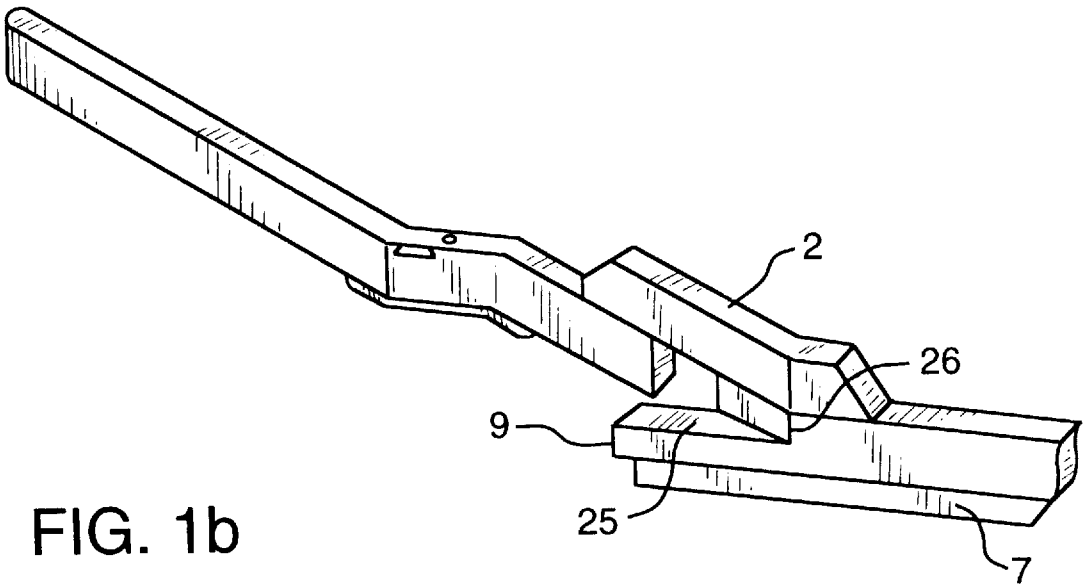
FIG. 1*b* is a bottom perspective view of a first preferred embodiment of the present invention.
Figure 4:
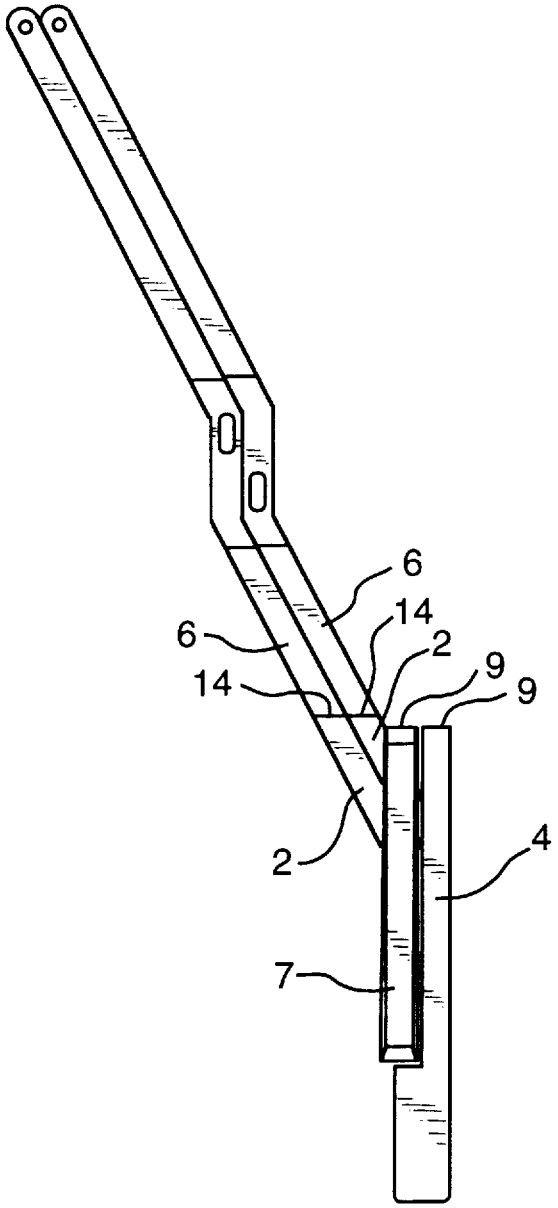
FIG. 4 is a top view of a natural (white) key and flat (black) key of the first preferred embodiment of present invention as the keys would be mounted in a keyboard.

In order to permit the stiffened keys to be operably mounted adjacent to each other clearance must be provided such that the depression of one key does not impact an adjacent key (see FIG. 4). In a preferred embodiment, this clearance is achieved by removing a section of the rear bottom portion of the playing end member 25 to a depth 26 sufficient to permit the key to be depressed without having the rear bottom portion of the playing end member 25 contact the adjacent key (see FIG. 1*b*). Clearance between the rear end 9 of the playing member 4 and the front portion 14 of the key shank 6 of an adjacent key should also be provided (see FIG. 4).

Figure 2:
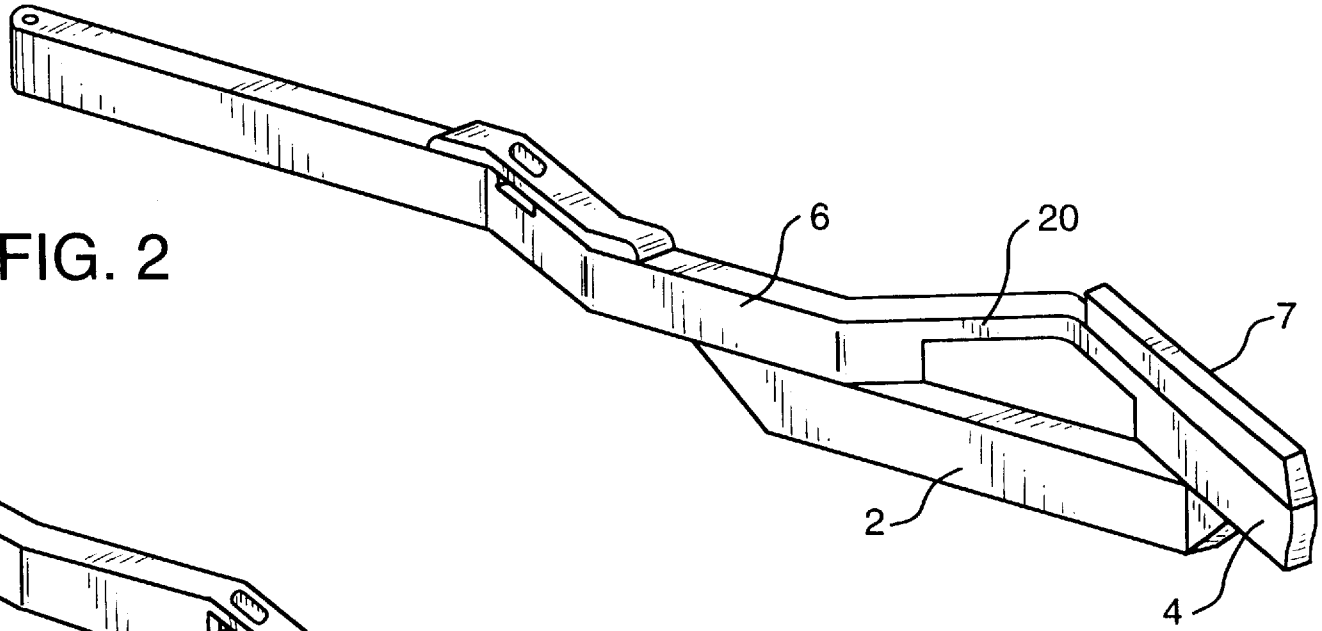
FIG. 2 is a perspective view of a second preferred embodiment of the present invention.
Figure 5:
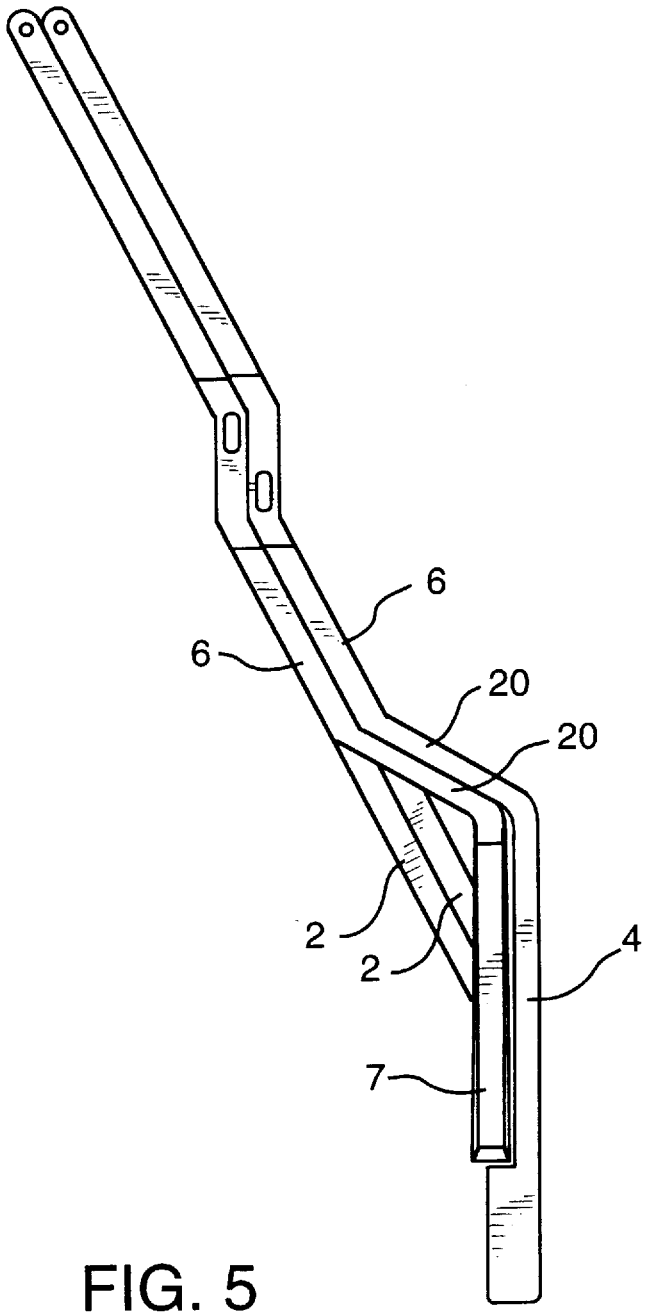
FIG. 5 is a top view of a natural (white) key and flat (black) key of the second preferred embodiment of present invention as the keys would be mounted in a keyboard.

In a preferred embodiment of the present invention, the playing end member 4 is discontinuous from the key shank front portion 6 and only indirectly connected to the key shank through the bracing member 2. In an alternative embodiment of the present invention, as shown in FIGS. 2 and 5, the front portion of the key shank 6 is connected to the playing end member 4 through a thin connecting member 20 continuous with both the key shank 16 and the playing end member 4. In this embodiment, clearance must also be provided such that depression of the piano key will not result in the bottom portion of the connecting member 20, contacting the top surface of the bracing member of an adjacent key. This clearance is preferably achieved by restricting the vertical thickness of the connecting member 20.

Figure 6:
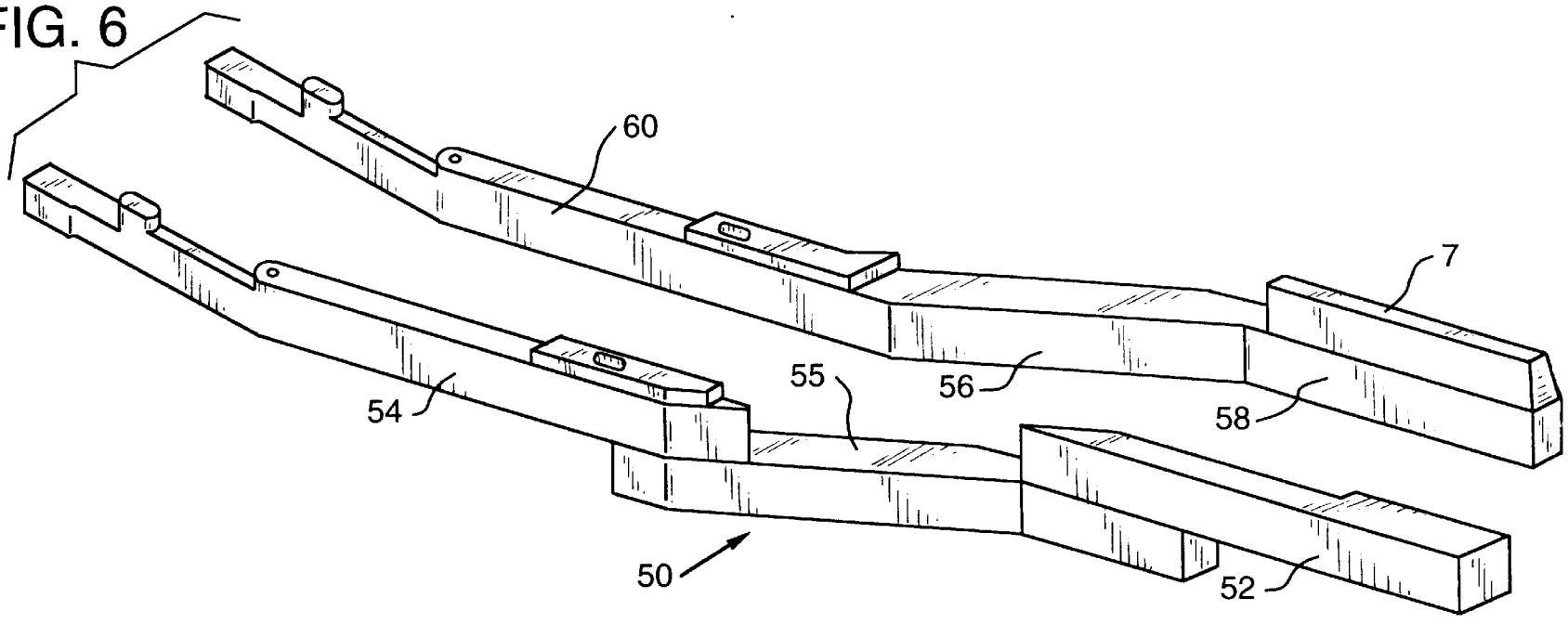
FIG. 6 is a perspective view of a third preferred embodiment of the present invention.
Figure 6A:
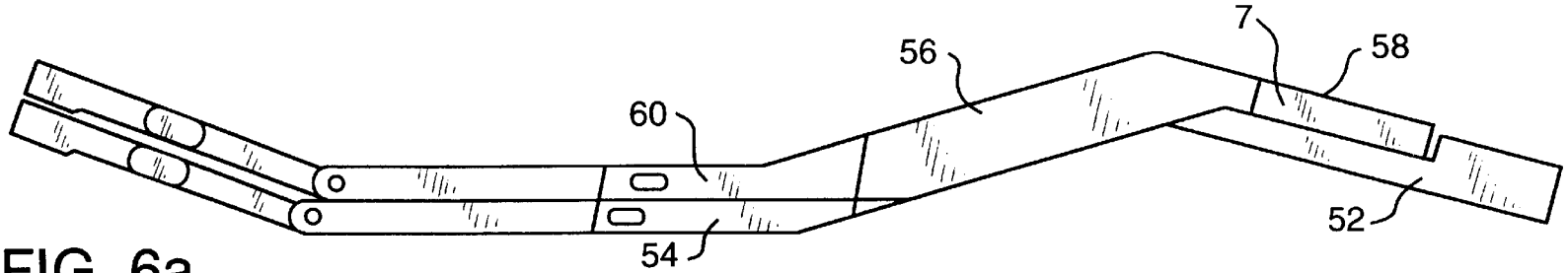
FIG. 6*a* is a top view of the third preferred embodiment the present invention.

As shown in FIGS. 6 and 6*a*, as another alternative embodiment, a first and second key are combined to make a key unit. The first key comprises a playing end member 52, a bracing member 50 and a key shank 54. The playing end member 52 and the key shank 54 are mounted on top of the ends of the bracing member 50. The bracing member 50 has a center portion 55 of a width greater than the width of the key shank 54, to impart greater stiffness to the first key. The second key comprises a playing end member 58, a center portion 56 and a key shank 60. The width of the center portion 56 is substantially the same as the width of the center portion 55 of the first key bracing member 50 and greater than the width of key shank 60, to impart greater stiffness to the second key. The center portion of the second key 56 is disposed on top of and aligned with the center portion 55 of the bracing member 50 of the first key (see FIG. 6*a*). Sufficient clearance between the bottom surface of the center portion 56 of the second key and the top of the center portion 55 of the bracing member must exist such that the operation of the second key will not interfere with the first key. Clearance may be obtained by tapering the top surface of the bracing member along the portion of the bracing member that underlies the center portion of the second key. Alternatively, a section of the bottom surface of the center portion of the second key can be removed, or a combination of tapering the bracing member of the first key and removing some of the center portion from the bottom surface of the second key can be used.

It is contemplated that the key shank, bracing member and playing end member components of the present invention may be formed from wood, plastic or any other material found suitable to form piano keys. It is further contemplated that the bracing member can be secured to the front portion of the key shank and the playing end member by generally known glues or adhesive materials and/or mechanical fastening devices. Alternatively, the bracing member could be integrally formed with the playing end portion and key shank should the key be manufactured by injection molding or other similar processes.

As shown and described above, the present invention provides an improved key for musical keyboard instruments, with the key having a stronger structural stiffness and greater torsional rigidity than conventional keys.

It is specifically contemplated that the present invention may be modified or configured as appropriate for the application. It is intended that the foregoing detailed description be regarded as illustrative rather than limiting, and it should be understood that the following claims, including any equivalents, are intended to define the scope of the invention.

I claim:

1. A key for a musical instrument comprising:

a playing end member, having a front and rear end, and a bottom surface extending between said front and rear end;

a key shank having a first and second end, said second end adapted to engage a capstan mechanism of a piano; and a bracing member having a first and second end, said second end connected to the first end of said key shank, and said first end of the bracing member having a top surface;

wherein a portion of the top surface of the first end of said bracing member is connected to said playing end member along a portion of the bottom surface of said playing end member.

2. The key as in claim 1 wherein said playing end member is continuous with said key shank.

3. The key as in claim 1 wherein said playing end member is offset from said key shank.

4. The key as in claim 1 wherein said bracing member is integrally connected to said playing end member and said key shank.

5. The key as in claim 1 wherein said playing end member is angled relative to the first end of said key shank.

6. A key for a musical instrument comprising:

a bracing member having a first and second end;

a playing end member mounted on top of the first end of said bracing member; and a key shank having a first end, said first end mounted on top of the second end of said bracing member.

7. The key as in claim 9 wherein said bracing member is integrally connected to said playing end member and said key shank.

8. The key as in claim 6 wherein said playing end member is offset from said key shank.

9. The key as in claim 6 wherein said playing end member is angled relative to the first end of said key shank.

10. The key as in claim 6 wherein said playing end member is continuous with said key shank.

11. A key unit for a musical instrument comprising:

a first key, said first key comprising a playing end member;

a key shank, having a first and second end, said second end adapted to engage a capstan mechanism of a piano; and a bracing member disposed below said key shank and said playing end member, said bracing member having a first and second end, wherein said first end is connected to the first end of said key shank and said second end is connected to said playing end member, said bracing member further comprising a center portion disposed between said first and second ends, said center portion having a width greater than the width of said key shank; and a second key, said second key comprising a playing end member;

a center portion connected to said playing end member, said center portion disposed above said bracing member of said first key and having substantially the same width as the center portion of said bracing member of said first key; and a key shank, having a first and second end, said second end adapted to engage a capstan mechanism of a piano, said first end connected to said center portion.

12. A keyboard for a musical instrument containing a plurality of keys wherein at least one key comprises:

a bracing member having a first and second end, a playing end member mounted on top of the first end of said bracing member; and a key shank, having a first and second end, said first end mounted on top of the second end of said bracing member.

13. The key as in claim 1 wherein said portion of the top surface of the first end of said bracing member is connected to the bottom surface of said playing end member at a location inwards from the rear end of said playing end member.

14. The key as in claim 1 wherein said portion of the top surface of the first end of said bracing member is connected to the bottom surface of said playing end member at approximately the longitudinal midpoint of the playing end member.

15. The key as in claim 1 wherein the bracing member is connected along the bottom surface of said playing end member from a position inwards from the rear end of said playing end member and extending to approximately the longitudinal midpoint of the playing end member.

16. The key as in claim 1 wherein a substantial portion of said bracing member is disposed beneath said playing end member and said key shank.

17. The keyboard as in claim 12 wherein a portion of said bracing member of said one key is disposed below a portion of the playing end member of at least one adjacent key.

* * * * *